US009579544B2

(12) United States Patent
Watterson

(10) Patent No.: US 9,579,544 B2
(45) Date of Patent: Feb. 28, 2017

(54) EXERCISE MACHINE WITH MULTIPLE CONTROL MODULES

(71) Applicant: ICON Health & Fitness, Inc., Logan, UT (US)

(72) Inventor: Scott R. Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 46 days.

(21) Appl. No.: 14/584,547

(22) Filed: Dec. 29, 2014

(65) Prior Publication Data

US 2015/0182800 A1 Jul. 2, 2015

Related U.S. Application Data

(60) Provisional application No. 61/922,698, filed on Dec. 31, 2013.

(51) Int. Cl.

| | |
|---|---|
| ***A63B 24/00*** | (2006.01) |
| ***A63B 22/02*** | (2006.01) |
| *A63B 71/06* | (2006.01) |

(52) U.S. Cl.

CPC ..... *A63B 24/0087* (2013.01); *A63B 22/02* (2013.01); *A63B 22/025* (2015.10); *A63B 22/0242* (2013.01); *A63B 2024/0093* (2013.01); *A63B 2071/065* (2013.01)

(58) Field of Classification Search

CPC . A63B 24/00; A63B 24/0062; A63B 71/0619; A63B 71/0622; A63B 21/154; A63B 21/0052; A63B 24/0087; A63B 22/02; A63B 22/0242; A63B 22/025; A63B 2024/0093; A63B 2071/065

See application file for complete search history.

(56) References Cited

U.S. PATENT DOCUMENTS

| | | | | |
|---|---|---|---|---|
| 4,635,928 | A | 1/1987 | Johnson et al. | |
| 4,729,558 | A | 3/1988 | Kuo | |
| 5,813,947 | A * | 9/1998 | Densmore | A63B 22/205 482/51 |
| 5,868,648 | A | 2/1999 | Coody et al. | |
| 7,192,388 | B2 | 3/2007 | Dalebout et al. | |
| 8,485,945 | B2 * | 7/2013 | Leonhard | A63B 21/0052 482/52 |
| 8,512,210 | B2 * | 8/2013 | Shauli | A63B 21/154 482/130 |
| 8,876,661 | B2 * | 11/2014 | Lu | A63B 71/0619 482/1 |
| 2003/0096675 | A1 | 5/2003 | Wang | |
| 2006/0247109 | A1 * | 11/2006 | Powell | A63B 71/0622 482/148 |
| 2008/0234111 | A1 * | 9/2008 | Packham | A63B 22/02 482/54 |
| 2010/0035726 | A1 | 2/2010 | Fisher et al. | |
| 2012/0088633 | A1 * | 4/2012 | Crafton | A63B 22/0235 482/1 |
| 2014/0121066 | A1 * | 5/2014 | Huang | A63B 22/02 482/54 |

* cited by examiner

*Primary Examiner* — Glenn Richman
(74) *Attorney, Agent, or Firm* — Maschoff Brennan

(57) ABSTRACT

An exercise machine includes a desk connected to a frame of the exercise machine. The desk has a first control module on a first side of the desk. The exercise machine also has a second control module located off of a first side of the desk.

11 Claims, 7 Drawing Sheets

EXERCISE MACHINE WITH MULTIPLE CONTROL MODULES

RELATED APPLICATIONS

This application claims priority to provisional Patent Application No. 61/922,698 titled "Exercise Machine with Multiple Control Modules" filed Dec. 31, 2013. This application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, cycling, among others. In contrast, anaerobic exercise typically involves high intensity exercises over a short duration of time. Popular forms of anaerobic exercise include strength training and short distance running Many choose to perform aerobic exercises indoors, such as in a gym or their home. Often, a user will use an aerobic exercise machine to have an aerobic workout indoors. One such type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical machines, rowing machines, stepper machines, and stationary bikes to name a few.

One type of treadmill is disclosed in U.S. Pat. No. 4,635,928 issued to Ralph Odgen, et al. In this reference, a treadmill apparatus has hand hold railings on either side between which the treadmill user exercises, with one of the hand rails having mounted on and connected with the treadmill drive motor assembly. Further, the hand rail includes a control mechanism that is adapted for hand actuation by the treadmill user when using the treadmill for changing of the tensioning of the pulley belt and the adjustment of the variable speed pulley for convenient infinitely variable speed changing of this treadmill belt between its maximum and minimum speeds provided by the treadmill apparatus involved and protection of the drive equipment against damage. Another type of treadmill is described in U.S. Pat. No. 4,729,558 issued to Hai Kuo. Each of these references is herein incorporated by reference for all that they contain.

SUMMARY

In one aspect of the invention, an exercise machine includes a frame.

In one aspect of the invention, a desk is connected to the frame of the exercise machine.

In one aspect of the invention, the desk may further include a first control module on a first side of the desk where the first control module is in communication with an exercise mechanism of the exercise machine.

In one aspect of the invention, the exercise machine may further include a second control module located on the exercise machine off of the first side of the desk.

In one aspect of the invention, the exercise machine further include that the second control module comprises at least one control that is redundant to a control of the first control module.

In one aspect of the invention, the desk is rotatably secured to the frame where the first control module is visible to the user operating the exercise mechanism when the desk is in a first position.

In one aspect of the invention, the exercise machine may further include a first control module being concealed to the user when the desk is rotated into a second position.

In one aspect of the invention, the exercise machine may further include an expanded level of control being accessible to the user operating the exercise mechanism when the desk is in the first position and a reduced level of control is accessible to the user when the desk is in the second position.

In one aspect of the invention, the second control module is located in a hand hold of the exercise machine.

In one aspect of the invention, the second control module is located on a back side of the desk and is visible to the user operating the exercise mechanism when the desk is rotated into a second position.

In one aspect of the invention, the second control module is concealed to the user when the first control module is deployed to the user operating the exercise mechanism.

In one aspect of the invention, the second control module is disabled when the first control module is deployed to the user operating the exercise mechanism.

In one aspect of the invention, the exercise machine may further include a memory storage medium comprising programmed instructions that, when executed, cause a processor to disable the second control module.

In one aspect of the invention, the exercise machine may further include a memory storage medium comprising programmed instructions that, when executed, cause a processor to control an operation of the exercise machine based on user input from the second control module.

In one aspect of the invention, the exercise machine may further include a back side that is opposite the first side comprises a flat working surface.

In one aspect of the invention, the desk is pivotally connected to a frame of the exercise machine.

In one aspect of the invention, the desk further comprises a first control module on a first side of the desk where the first control module is in communication with an exercise mechanism of the exercise machine when the desk is rotated about a pivot in a first position.

In one aspect of the invention, the desk further comprises a back side that allows a user to support an object while simultaneously operating the exercise mechanism when the desk is rotated about the pivot in a second position.

In one aspect of the invention, the exercise machine further include a second control module located elsewhere on the exercise machine.

In one aspect of the invention, the second control module is located in a hand hold of the exercise machine.

In one aspect of the invention, the second control module is located on a back side of the desk and visible to the user operating the exercise mechanism when the desk is rotated into the second position.

In one aspect of the invention, the second control module is concealed to the user when the first control module is deployed to the user operating the exercise mechanism.

In one aspect of the invention, the second control module is disabled when the first control module is deployed to the user operating the exercise mechanism.

In one aspect of the invention, the exercise machine may further include a back side that is opposite the first side comprises a flat working surface and the second control module is located on the back side.

In one aspect of the invention, an exercise machine includes a frame.

In one aspect of the invention, the exercise machine may further include a desk pivotally connected to a frame of the exercise machine.

In one aspect of the invention, the desk further comprises a first control module on a first side of the desk where the first control module is in communication with an exercise mechanism of the exercise machine when the desk is rotated about a pivot in a first position.

In one aspect of the invention, the desk comprises a back side that allows a user to support an object while simultaneously operating the exercise mechanism when the desk is rotated about the pivot in a second position.

In one aspect of the invention, the exercise machine may further include a second control module located elsewhere on the exercise machine and comprising at least one control that is redundant to a control of the first control module.

In one aspect of the invention, the desk is rotatably secured to the frame where the first control module is visible to the user operating the exercise mechanism when the desk is in a first position and the first control module is concealed to the user when the desk is rotated into the second position.

In one aspect of the invention, the exercise machine may further include a memory storage medium comprising programmed instructions that, when executed, cause a processor to disable the second control module.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Figure 1:
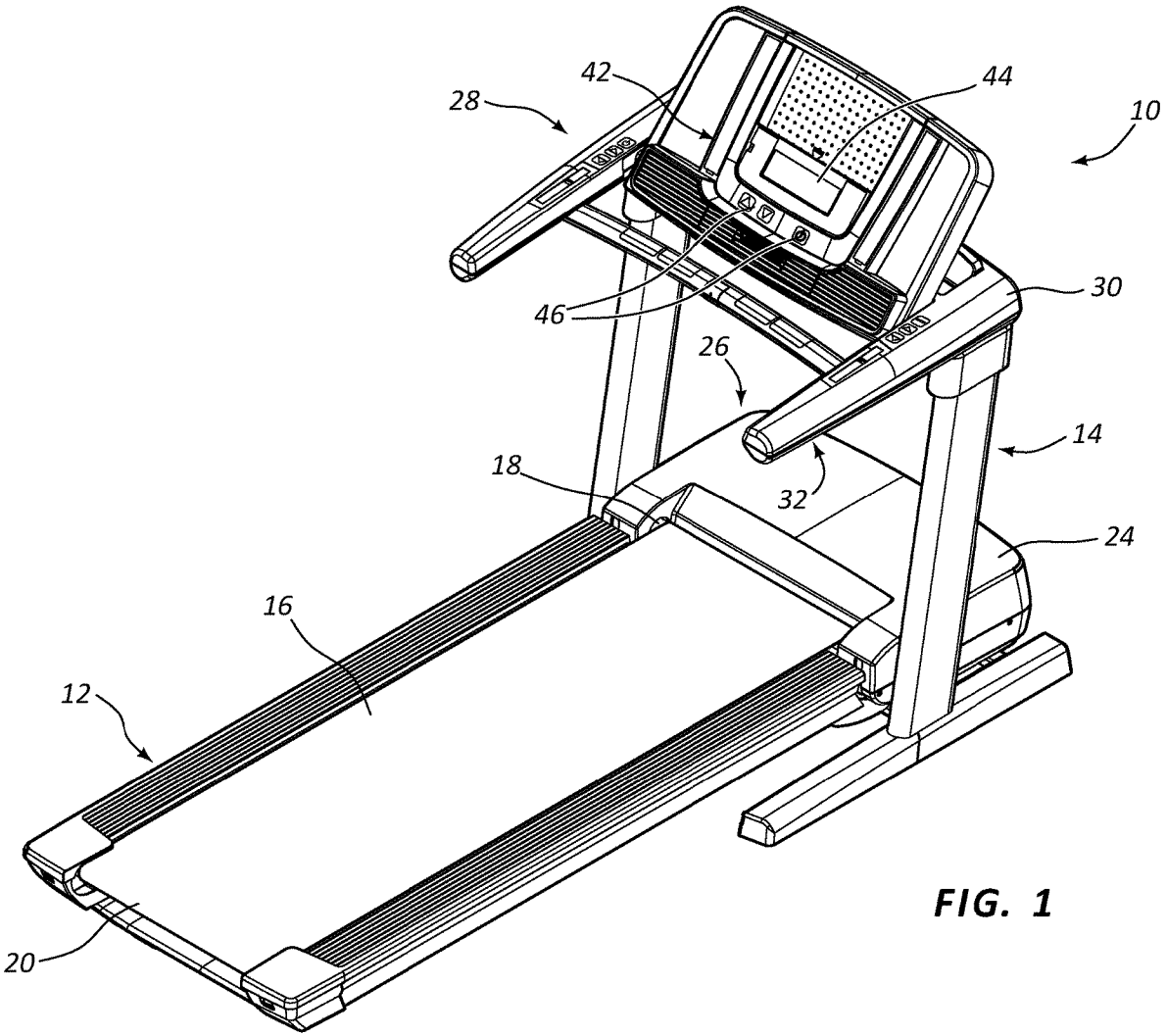
FIG. 1 illustrates a perspective view of an example of an exercise machine in accordance with the present disclosure.

A desk is attached to the exercise machine's frame directly or indirectly through another component of the aerobic exercise machine. Such a desk may incorporate a display, a first control module, or other features to assist the user through a workout. The desk may be capable of folding downward in front of the user while the user is exercising on the exercise machine. Such a desk may be capable of supporting an object that is independent of the aerobic exercise machine, such as a laptop, an electronic tablet, or other object. A control module may be incorporated into the first side of the desk such that when the desk is in the folded up position, the control module is accessible to the user during the user's workout. However, when the desk is folded down, the control module integrated into the first side of the desk will be concealed to the user during the workout. To still provide the user a degree of control during the workout while the desk is folded downward, the user may use a second control module that is located elsewhere other than the first side of the desk. For example, the second control module may be incorporated into a hand hold, the back side of the desk, an arm rest, a guide, a railing, another location on the treadmill, or combinations thereof to provide the user a degree of control during the workout.

The degree of control which the user may have while the desk is folded downward may be a diminished degree of control or display as compared to when the first control module on the first side of the desk is accessible to the user. Further, the control on the second control module may include redundant controls that are also incorporated into the first control module. In view that some of the controls of the second control module may be redundant to those controls of the first control module, the exercise machine may include a mechanism that causes the second control module to be disabled when the first control module is accessible to the user. In such a manner, inadvertently made commands through the second control module are not executed by the exercise machine.

Controls incorporated into either the first control module or the second control module may include controls to adjust the speed of the conveyor belt, adjust the amount of resistance to an exercise mechanism, operate a timer, execute a preprogrammed workout written to memory of the of the exercise machine, control a volume of a program of the exercise machine, adjust a tilt of the exercise mechanism of the exercise machine, control another operation of the exercise machine, or combinations thereof.

For the purposes of the present disclosure, the term "exercise mechanism" refers to the collective group of components of an exercise machine that allow the user to exercise with the machine. Examples of such exercise mechanisms include, but are not limited to, a treadmill running deck, pedals of a stationary bike or elliptical machine, or another exercise mechanism of a different type of exercise machine, or combinations thereof.

Figure 2:
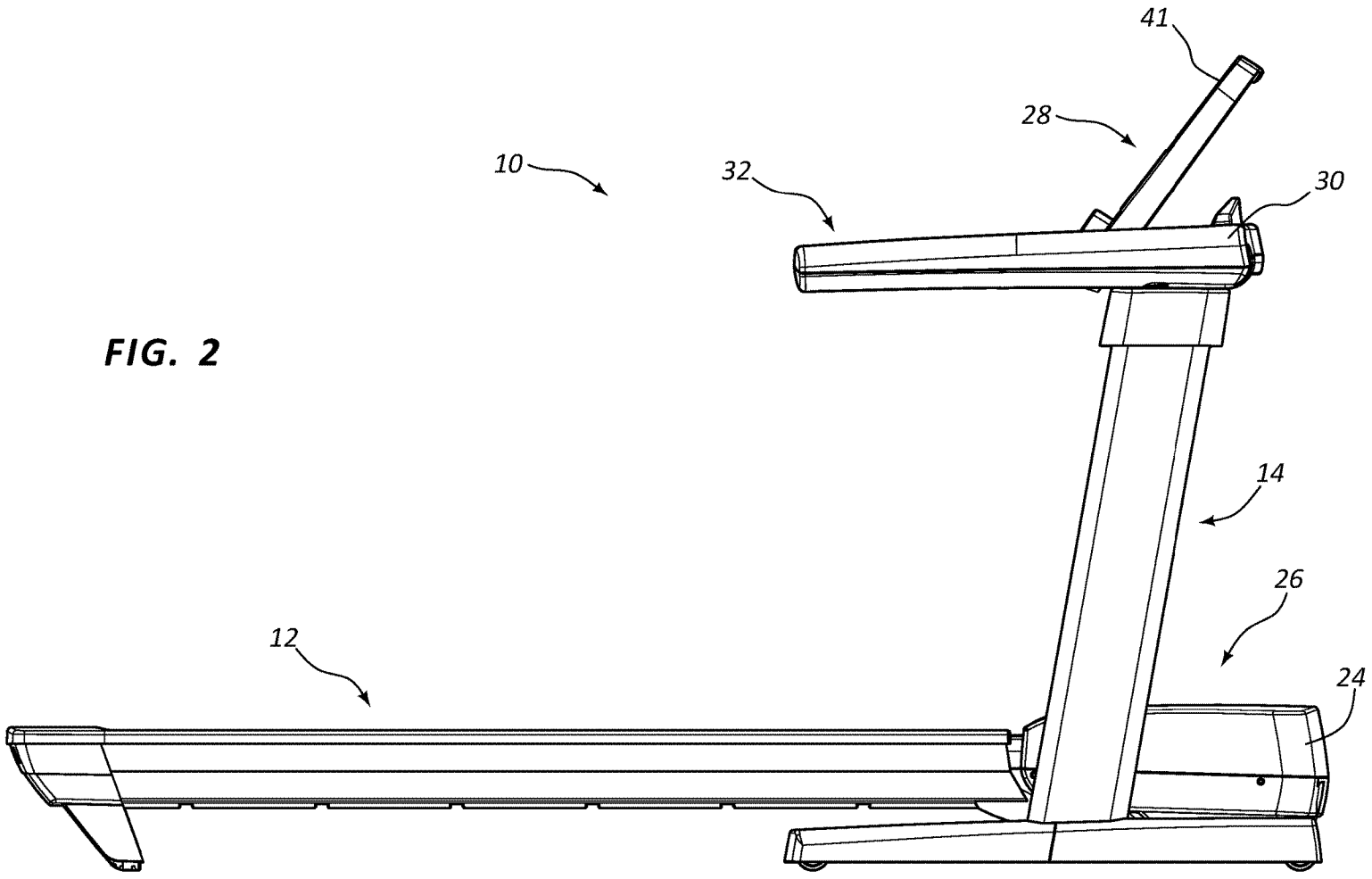
FIG. 2 illustrates a right side view of the aerobic exercise machine of FIG. 1.

Particularly, with reference to the figures, FIGS. 1-2 depict an exercise machine 10, such as a treadmill. The exercise machine 10 includes a running deck 12 that can support the weight of a user and that is attached to a frame 14. The running deck 12 incorporates a conveyor belt 16 that extends from a first pulley 18 to a second pulley (not shown) at location 20. The underside of the conveyor belt's mid-section is supported by a low friction surface that allows the conveyor belt's underside to move without creating significant drag. The conveyor belt 16 is moved by a motor (not shown) that is connected to the first pulley 18 and is disposed within a housing 24 in a front portion 26 of the running deck 12. As the conveyor belt 16 moves, a user positioned on the conveyor belt 16 can walk or run in place by keeping up with the conveyor belt's speed.

A desk 28 is also supported by the frame 14. In the example of FIG. 1, a support member 30 positions a set of hand holds 32 near the desk 28 such that a user can support himself or herself during exercise. The support member 30 is attached to a top end 34 of the frame 14. The desk 28 is supported by the first arm 36 and the second arm 38 of the support member 30 on which the hand holds 32 are formed. Further, a grip bar 40 extends from the first arm 36 to the second arm 38.

The desk 28 allows the user to perform a predetermined task while simultaneously operating an exercise mechanism of the exercise machine 10 such as operating the running deck 12. Such predetermined tasks may be tasks that can be executed by a first control module 42 incorporated into a first side 41 of the desk 28. The first control module 42 may include controls to adjust the speed of the conveyor belt 16, adjust a volume of a speaker integrated into the exercise machine 10, adjust a tilt angle of the running deck 12, select an exercise setting, control a timer, change a view on the first control module's display 44, monitor the user's health parameters, perform other tasks, or combinations thereof. Buttons, levers, touch screens, or other mechanisms may be incorporated into the control panel and may be used by the user to control at least some of the functions mentioned above.

Figure 3:
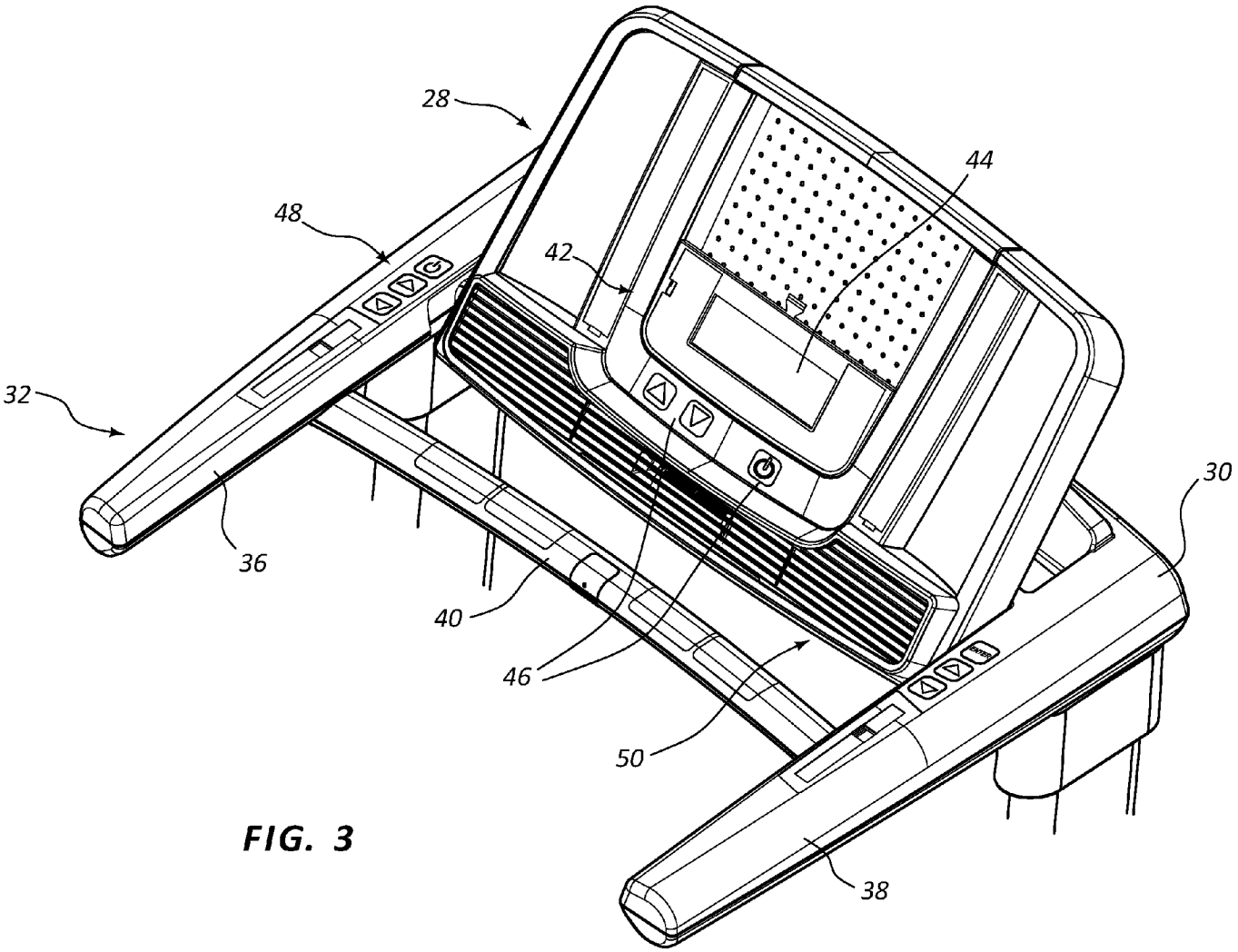
FIG. 3 illustrates a front perspective view of an example of a desk in accordance with the present disclosure.

Referring to FIG. 3, the first side 41 of the desk 28 includes the first control module 42, which incorporates the display 44 and multiple buttons 46 that can be used to control the functions mentioned above. Information relating to these functions may be presented to the user through the display 44. For example, a calorie count, a timer, a distance, a selected program, another type of information, or combinations thereof may be presented to the user through the display 44.

In the example of FIG. 3, a second control module 48 is incorporated into the hand holds 32 of the support member 30. The user may grip the hand holds 32 during the workout for support. The second control module 48 may be located in just one of the hand holds 32, be distributed across both of the hand holds 32, be distributed across at least one of the hand holds 32 and another location on the exercise machine 10, or just located at another location on the exercise machine 10. Preferably, the locations where the second control module 48 is incorporated are within arm's reach for the user while the user is in an appropriate upright position when a user that is operating the exercise mechanism of the exercise machine. In other words, the locations preferably do not cause the user have to bend or stoop down to access the second control module 48.

The controls of the second control module 48 may be completely redundant to the controls of the first control module 42. In other examples, the controls of the second control module 48 include fewer controls than the first control module 42. In yet other examples, the second control module 48 includes controls that are not incorporated into the first control module 42.

The user may fold the desk 28 before the user starts a workout. In some embodiments, the user can operate the folding mechanism of the desk 28 while standing next to the exercise machine 10 or while standing on the running deck 12 or another exercise mechanism of the exercise machine. The user may also operate the folding mechanisms of the desk 28 while the running deck 12 or another exercising mechanism of the exercise machine 10 is operating during the user's workout. In such examples, the folding mechanism is easy and convenient for a user to operate with a partial focus on folding down the desk 28 and a partial focus on the workout.

The folding mechanism may include a pivot bar, a hinge, or another mechanism that allows the desk 28 to be rotated to rotated downward to hold an object. In the example of FIG. 3, the desk 28 is connected at a single edge 50 of the desk 28 and at this connection the desk 28 rotates to fold into the support member 30 to provide the back side of the desk 28 for placing objects. In other examples, a different region of the desk 28 than described above is connected to the support member 30, the frame 14, or another component of the exercise machine 10, but still allows the desk 28 to fold in. For example, the desk 28 may have an ability to rotate about its midsection. Any appropriate region of the desk 28 may be involved with the connection that allows the desk 28 to fold in.

A first stopping mechanism may be used to stop the desk 28 in an upright position so that the user has access to the first control module 42. In some examples, such a first stopping mechanism may include a back rest that holds the desk 28 in an upright position. The user may rotate the desk 28 up until the desk 28 rests against the back rest at a position that gives the user access to the first control module 42. Further, a second stopping mechanism may be used to stop the desk 28 in a downward position such that the first control module 42 is concealed to the user and the desk's flat surface 54 can be used to hold objects. Such a second stopping mechanism may include a grip bar 40 that may stop the desk 28 from further downward rotation and provide a load bearing support capable of supporting the weight of any appropriate objects placed on the desk during a user's workout. While this example has been described with reference to specific types of folding mechanisms and stopping mechanisms, any appropriate type of folding mechanism or stopping mechanism may be used in accordance with this principles described in the present disclosure.

Figure 4:
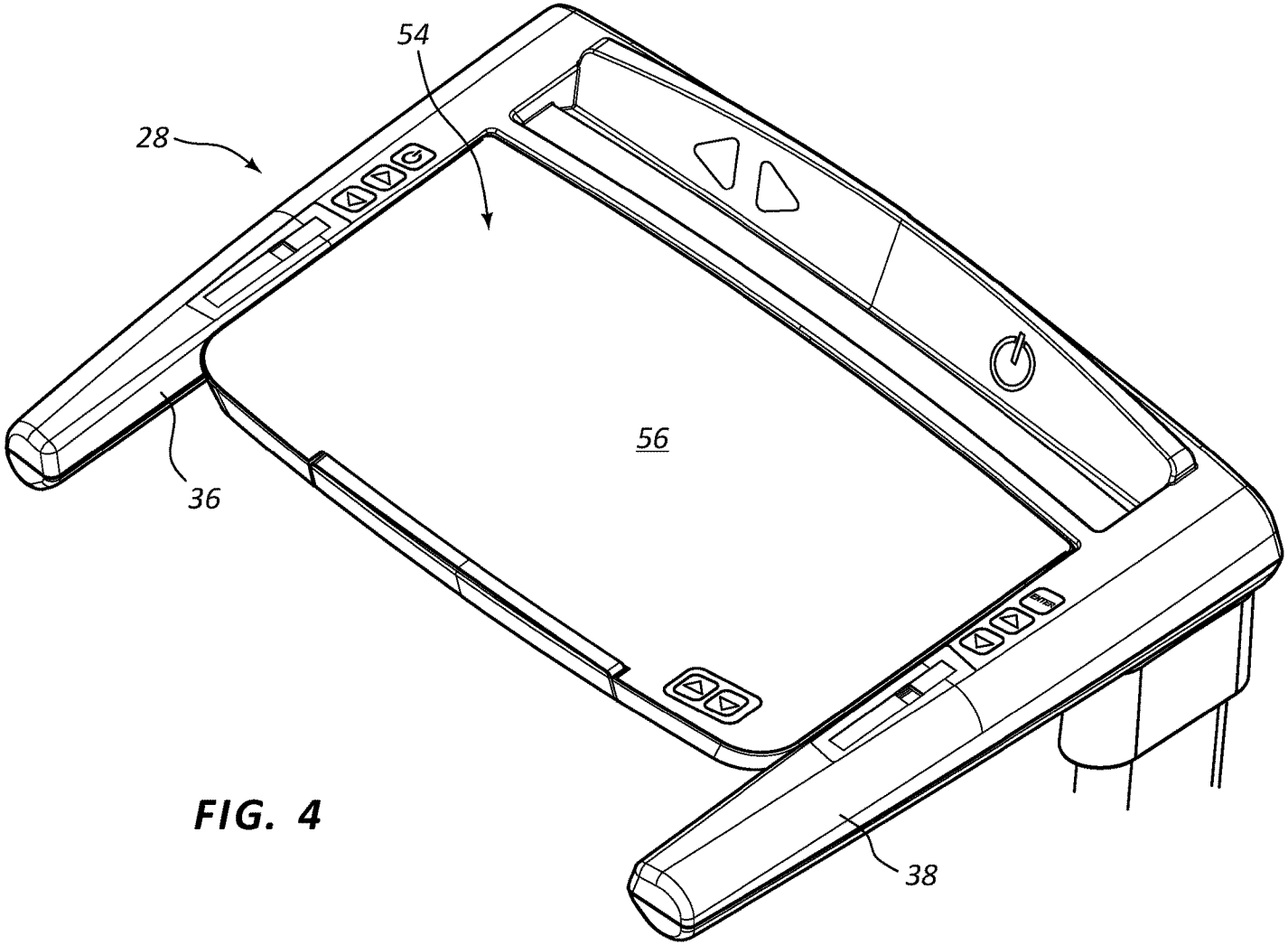
FIG. 4 illustrates a front perspective view of an example of a desk in accordance with the present disclosure.

FIG. 4 illustrates a front perspective view of an example of a desk in accordance with the present disclosure. In some embodiments, the user may desire to have entertainment while exercising. Some entertainment may be available to the user through the display 44 of the first control module 42. Further, a user may desire to work on a project while exercising that may not be available through the display 44 or the first control module 42. In such instances, the user may fold down the desk where the back side of the desk 28 has a flat surface 54 that is capable of holding an object that the user can operate during the user's workout.

In the example of FIG. 4, the desk 28 is folded downward. In such a position, the desk 28 conceals the first control module 42 such that the first control module 42 is inaccessible to the user. Under such circumstances, the user may operate the functions of the exercise machine 10 through the second control module 48. The back side 56 of the desk 28 may include a flat surface, a recessed surface, or another type of surface that is capable of holding desirable objects. In some instances, the user may desire to use a laptop during a workout. Here, the user may fold the desk 28 down and place the laptop on the back side 56 of the desk 28.

The exercise machine 10 may include a mechanism that causes the first control module to be deactivated when the desk 28 is folded downward. Likewise, the mechanism may cause the second control module 48 to be deactivated when the desk 28 is rotated into an upright position such that the first control module 42 is accessible to the user. Any appropriate type of mechanism may be used to activate/deactivate the first control module 42 or the second control module 48. For example, a processor may be used to determine the accessibility of the first control module 42. The processor may make such a determination based on a position of the desk 28, a manual input, a responsiveness of the first control module 42, another factor, or combinations thereof.

In a specific example, such a mechanism for activating/deactivating either the first control module 42 or the second control module 48 may include a mechanical or electrical switch that operates based on the physical position of the desk 28. For example, a mechanical switch that electrically connects or disconnects the second control module 48 may be driven by the movement of the desk 28. In such an example when the desk 28 is rotated into a downward position, a part of the mechanical switch may be brought into a position with another part of the switch such that an electrically conductive connection is established. As a result, the second control module 48 can receive electrical power through the electrically conductive connection. Under such circumstances, the second control module 48 can be enabled for operation. Continuing with the example with the mechanical switch, when the desk 28 is moved into an upright position such that the first control module 42 is accessible to the user, a part of the mechanical switch may move with the desk 28 such that the electrically conductive connection is disconnected. As a result, the electrically conductive path that provides a supply of electrical power to the second control module 48 is broken. Without power, the second control module is disabled for operation.

When the desk 28 is folded downward, the display 44 of the first control module 42 may be concealed. In such an example, communications from the display 44, such as speed, distance, calorie counts, and other information that the exercise machine 10 may track and present to the user through the display 44 will not be accessible to the user through the first control module 42. In some embodiments, such information is conveyed to the user through another mechanism. In some examples, another display may be incorporated into the exercise machine 10, such as through the back side 56 of the desk 28, where such information may be continued to be presented to the user. In other examples, an audio mechanism may verbally announce milestones such as timer intervals, distance thresholds, calorie count thresholds, other milestones, or combinations thereof. In some examples, the user may have an option to provide manual input through the second control module 48 to instruct the exercise machine 10 to recite the current status of items such as time, distance, calorie count, or other information regardless of whether a milestone is reached.

Figure 5:
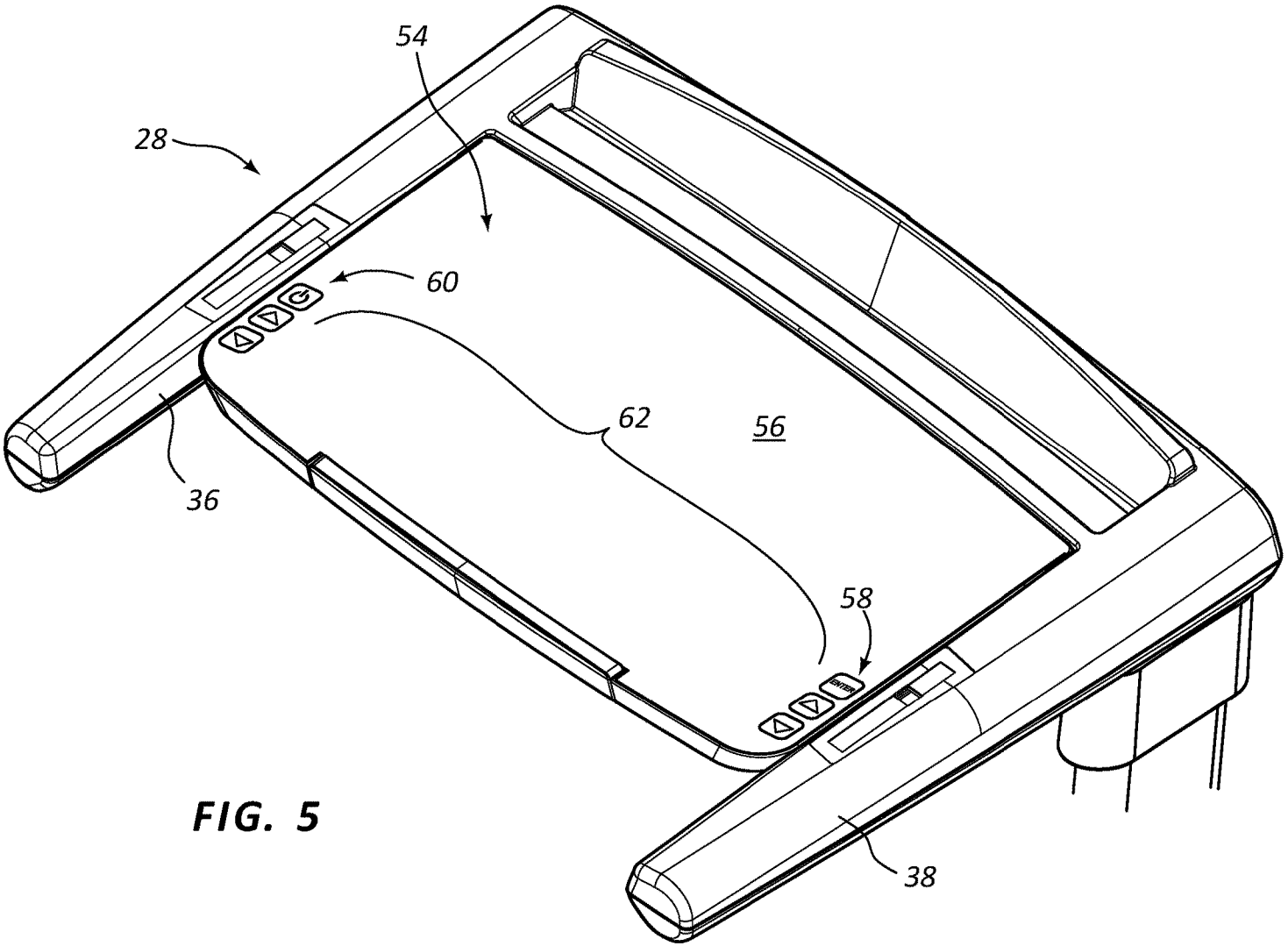
FIG. 5 illustrates a front perspective view of an example of a desk in accordance with the present disclosure.

FIG. 5 illustrates a front perspective view of an example of a desk in accordance with the present disclosure. In this example, the second control module 48 is incorporated into the back side 56 of the desk 28. The buttons 46 of the second control module 48 may be positioned to a right region 58, a left region 60, or to another region of the desk's back side 56 to accommodate the object to be held by the desk 28. If the user places a laptop on the back side 56 of the desk 28, the laptop can be situated in a free region 62 that is free of buttons 46 or other user input mechanisms of the second control module 48. As a result, the weight of the laptop does not press on the buttons 46 when the laptop is in the free region 62. Further, the laptop will not be positioned over the buttons 46 and thereby does not conceal the functionality of the buttons 46 of the second control module 48.

The back side 56 of the desk 28 may include features that are customized for specific objects that users are likely to use during workouts. One such likely object may be the laptop as mentioned above. Features incorporated into the back side 56 of the desk 28 specifically for standard sized laptops may include a spacing of buttons 46 in the right region 58 and the left region 60 such that there is sufficient space to place a laptop there between. Further, the back side 56 may include a stand that is shaped to support the weight of a laptop and provide some distance between the underside of a laptop where cooling vents are often placed and surface of the back side 56. Such an arrangement may allow hot air generated by the laptop to be dissipated through the laptop's cooling system quickly without being obstructed by the surface of the desks back side 56. In other examples, a heat sink may be incorporated into the back side 56 of the desk 28 where a laptop's cooling vents are located to quickly remove the heat from the laptop. In other examples, the back side 56 of the desk 28 may include a nested area that is sized to receive standard sized mobile devices, such as for electronic tablets or smart phones. Such nested areas may provide an edge that prevents the mobile device from sliding along the surface of the back side 56. While just a few features specific to laptops and other mobile devices have been described as being incorporated into the back side 56 of the desk 28, any appropriate feature for any appropriate type of object may be incorporated in accordance with the principles of the present disclosure.

Figure 6:
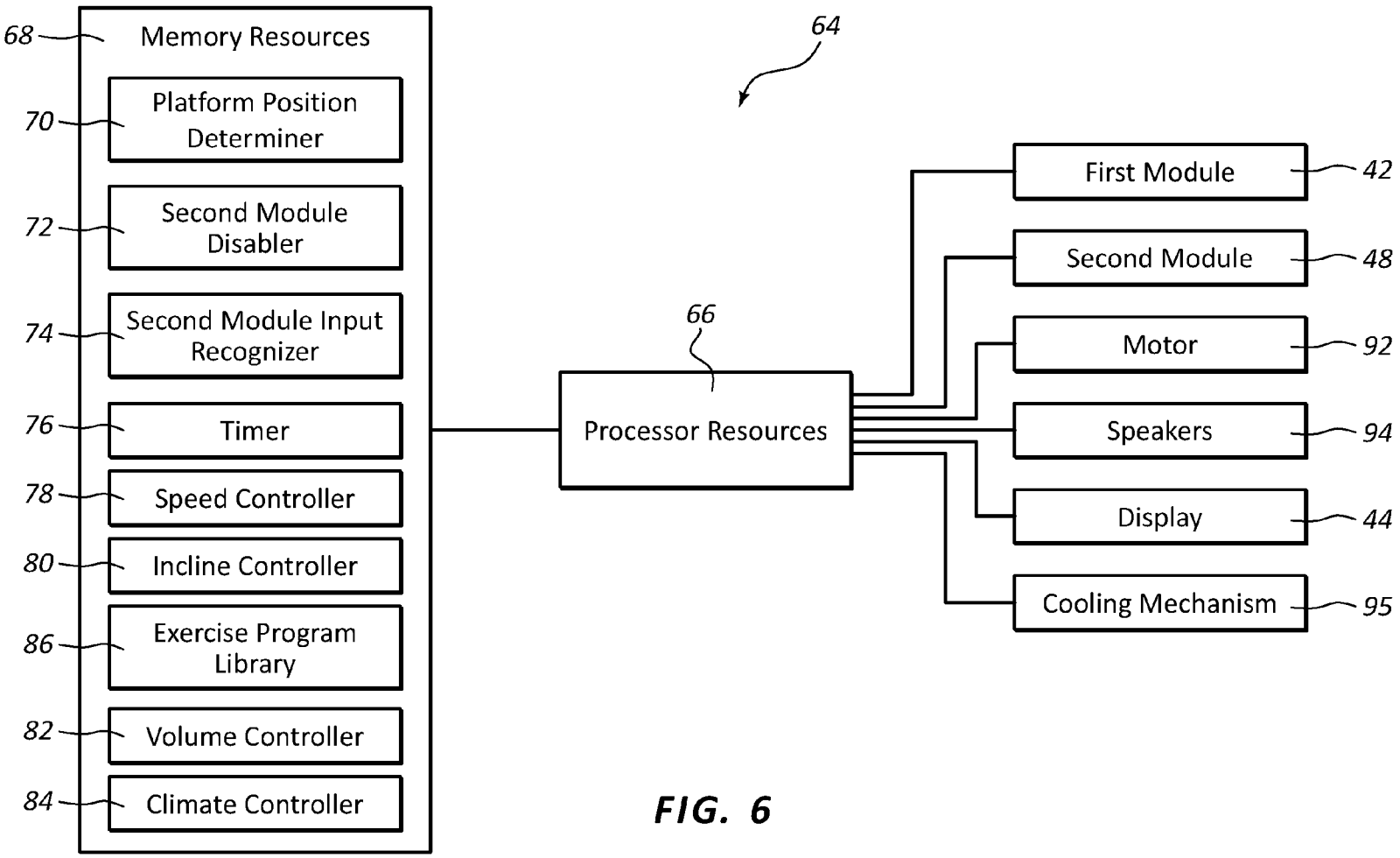
FIG. 6 illustrates an example of a control system integrated into an exercise machine in accordance with the present disclosure.

FIG. 6 illustrates an example of a control system 64 integrated into an exercise machine 10 in accordance with the present disclosure. The control system 64 may include a combination of hardware and programed instructions for executing the functions of the control system 64. In this example, the control system 64 includes processing resources 66 that are in communication with memory resources 68. Processing resources 66 include at least one processor and other resources used to process programmed instructions written to the memory resources 68. The memory resources 68 represent generally any memory capable of storing data such as programmed instructions or data structures used by the control system 64. The programmed instructions shown stored in the memory resources 68 include a desk position determiner 70, a second module disabler 72, a second module input recognizer 74, a timer 76, a speed controller 78, an incline controller 80, a volume controller 82, and a climate controller 84. The data structures shown stored in the memory resources 68 include an exercise program library 86.

The memory resources 68 include a computer readable storage medium that contains computer readable program code to cause tasks to be executed by the processing resources 66. The computer readable storage medium may be tangible and/or non-transitory storage medium. The computer readable storage medium may be any appropriate storage medium that is not a transmission medium. A non-exhaustive list of computer readable storage medium types includes non-volatile memory, volatile memory, random access memory, write only memory, flash memory, electrically erasable program read only memory, magnetic storage media, other types of memory, or combinations thereof.

The desk position determiner 70 represents programmed instructions that, when executed, cause the processing resources 66 to determine the position of the desk. For example, a position sensor may be incorporated in the desk 28 or at a joint that connects to the desk 28. Such a sensor may determine the current position of the desk. The desk position determiner 70 may actively retrieve a status position from such a position sensor or passively receive input from the position sensor in response to changes in the desk's position.

The second module disabler 72 represents programmed instructions that, when executed, cause the processing resources 66 to disable the second control module 48 under appropriate circumstances. For example, if the position of the desk 28 is determined to be in a downward position where the desk 28 has a flat surface 54, the second module disabler 72 may send a signal to the processing resources to ignore communications/input from the second control module 48. In other examples, the second module disabler 72 may cause an electrical break in a communication path between the processing resources 66 and the second control module 48. The second module disabler 72 may consider multiple factors when determining whether to disable the second control module 48. Such factors may include, but are not limited to, whether the processing resources 66 are receiving instructions from the first control module 42, whether instructions from the second control module 48 conflict with instructions from the first control module 42, the position of the desk 28, the functionality of the first control module 42, whether the first control module 42 has recently sustained damage, other factors, or combinations thereof. The second module input recognizer 74 represents programmed instructions that, when executed, cause the processing resources 66 to recognize inputs from the second control module 48 when the second control module 48 is not disabled.

The timer 76 represents programmed instructions that, when executed, cause the processing resources 66 to track a duration of time. The duration of time may represent the time period that starts at a moment as directed by the user through either the first control module 42 or the second control module 48.

The speed controller 78 represents programmed instructions that, when executed, cause the processing resources 66 to control the speed of the running deck 12. The speed controller 78 may cause the speed of the motor 92 that drives the conveyor belt of the running deck 12 to be at a speed as indicated by the user through either the first control module 42 or the second control module 48. In some instances, safety mechanisms can override inputs from the first control module 42 or the second control module 48 and can reduce the speed of the motor 92 to zero revolutions per minute if a safety trigger has been activated. In some instances the speed of the conveyor belt 16 is based on a preprogrammed workout selected by the user through either the first control module 42 or the second control module 48 from the exercise program library 86.

The incline controller 80 represents programmed instructions that, when executed, cause the processing resources 66 to adjust the incline of the running deck 12. The incline of the running deck 12 is based on input from the user through the first control module 42 or the second control module 48.

The volume controller 82 represents programmed instructions that, when executed, cause the processing resources 66 to adjust a volume of a speaker 94 that is associated with the display 44 or another communication mechanism of the exercise machine 10. The volume of the speaker 94 may be based on input from the user, which is received through the first control module 42 or the second control module 48.

The climate controller 84 represents programmed instructions that, when executed, cause the processing resources 66 to adjust a level of a cooling mechanism 95 incorporated into the exercise machine 10. For example, the cooling mechanism 95 may be a fan that is incorporated into the exercise machine 10, and the level may be the revolutions per minute that the fan rotates to cool the user during the user's workout. The level of the cooling mechanism 95 is based on input from the user that is received through the first control module 42 or the second control module 48.

Further, the memory resources 68 may be part of an installation package. In response to installing the installation package, the programmed instructions of the memory resources 68 may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources 66 and the memory resources 68 are located within the same physical component, such as a server, a network component, the exercise machine, or the like. The memory resources 68 may be part of the physical component's main memory, caches, registers, non-volatile memory, or elsewhere in the physical component's memory hierarchy. Alternatively, the memory resources 68 may be in communication with the processing resources 66 over a network. Further, the data structures, such as the libraries, may be accessed from a remote location over a network connection while the programmed instructions are located locally. Thus, the control system 64 may be implemented on a user device, on a server, on a collection of servers, or combinations thereof.

Figure 7:
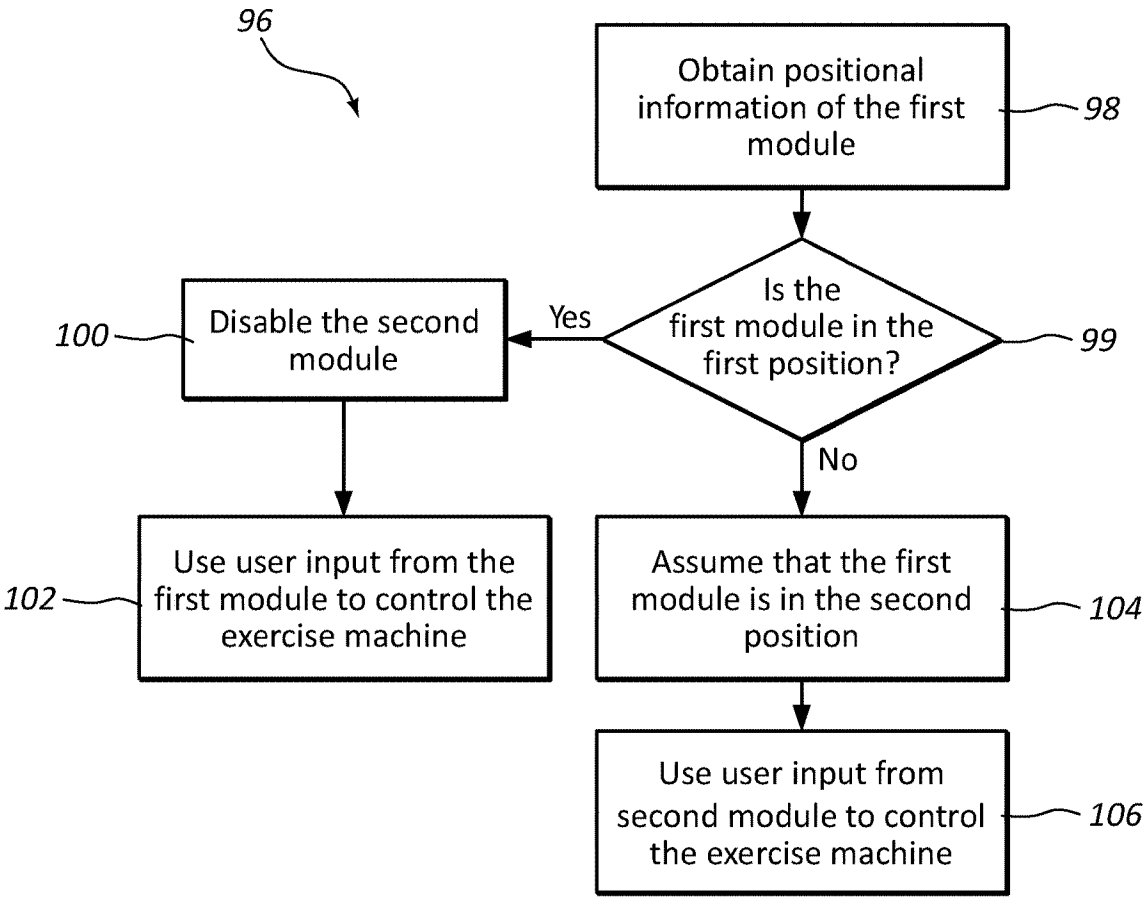
FIG. 7 illustrates an example of a method of determining when to disable a second control module in accordance with the present disclosure.

FIG. 7 illustrates an example of a method 96 of determining when to disable a second control module. In this example, the method 96 includes obtaining 98 positional information of the first module and determining 99 whether the desk is in a first position that corresponds to a position where the user has access to the first control module. If the desk is in the first position, then the method continues by disabling 100 the second control module and using 102 user input from the first control module 42 to control the exercise machine. If the desk is not in the first position, the method 96 includes assuming 104 that the desk is in a second position that corresponds to the desk concealing the first control module 42 and using 106 the user input from the second module to control the exercise machine. While this method has been described with reference to specific tasks, the method may include any appropriate type or number of tasks to determine when to use the first or the second module.

While the above embodiments have been described with specific reference to treadmills, the principles described in the present disclosure may be incorporated into any appropriate exercise machine. For example, the desk, the first control module, the second control module, and their associated components may be incorporated into elliptical machines, rowing machines, stepper machines, stationary bikes, other types of exercise machines, or combinations thereof. Further, while the examples above have been described with reference to a specific number of control modules being incorporated into the exercise machine, any appropriate number of control modules may be used in accordance with the present disclosure.

INDUSTRIAL APPLICABILITY

In general, the invention disclosed herein may provide a user the advantage of using a device that is independent of the exercise machine on which the user is performing a workout in an easy and convenient way. Such principles can be applied to any appropriate type of exercise machine. Examples of such exercise machines include, but are not limited to, treadmills, stationary bikes, elliptical machines, steppers, tracks, rowing machines, other types of aerobic machines, or combinations thereof. The desk described above can allows for common objects such as laptops or electronic tablets to be held within a convenient arm's reach while the exercise machine is operated by the user. Such devices may provide the user entertainment or information that may assist the user throughout his workout. Additionally, the present system allows for and facilitates the combination of work and exercise.

In some instances, the desk can rotate about a pivot type connection that connects an edge of the desk directly to the frame or indirectly to the frame through an intermediate component such as a supporting member. Stopping mechanisms, such as hand grips or back rests, can be disposed in locations that support the weight of the desk in both an operational position where the user has access to the first control module or a desk position where the first control module is concealed from the user. Folding mechanisms as described above allow the user to easily and conveniently fold the desk up or down while the user is standing adjacent to the exercise machine or while the user is standing on the running deck or other exercise mechanism during a workout.

The exercise machine as described in the present disclosure provides at least one additional set of controls that can be operated by the user. In situations where a first control module is inaccessible, the user can use a second control module that can provide at least some of the same functionality as the first control module. In some instances, the functionality provided to the user from the second control module is a reduced level of control than provided by the first control module. Such a reduced level of control may still allow the user to operate basic functions of the exercise machine. In some examples, the reduced level of controls includes an ability to adjust a speed of a motor driving a conveyor belt of the running deck, to adjust an incline of the running deck, to adjust a strength of a resistance mechanism, to control a volume incorporated into the exercise machine, to control a cooling mechanism incorporated into the exercise machine, to control other functions of the exercise machine, or combinations thereof.

The additional set of controls can be located in an area that is within a convenient arm's reach for the user while the user is operating the exercise machine. For example, the locations that may incorporate the additional control module may include the hand holds, the surface of the desk (back side of the desk), or other convenient locations.

Further, the principles described in the present disclosure include disabling a second or redundant set of controls when the first set of controls is accessible to the user. By disabling the second set of controls, the user will not inadvertently send errant instructions to the processing resources executing the operations of the exercise machine. The first and second control modules may include processing resources and memory resources that allow the user input mechanisms for both the first and second control modules to be located in small areas, such as in hand holds, in a surface of the desk's back side, another small area, or combinations thereof. Further, the processing resources and memory resources can be in communication with many components of the exercise machine at once. Therefore, the user can control multiple functions of the exercise machine from a single location or a single control module.

What is claimed is:

1. An exercise machine, comprising:

a frame;

a desk connected to the frame of the exercise machine, the desk including a first control module on a first side of the desk where the first control module is in communication with an exercise mechanism of the exercise machine; and a second control module located on the exercise machine off of the first side of the desk, wherein the desk is rotatably secured to the frame, wherein the first control module is visible to a user operating the exercise mechanism when the desk is in a first position, wherein the first control module is concealed from the user when the desk is rotated into a second position, and wherein an expanded level of control is accessible to the user operating the exercise mechanism when the desk is in the first position and a reduced level of control is accessible to the user when the desk is in the second position.

2. The exercise machine of claim 1, wherein the second control module is located in a hand hold of the exercise machine.

3. An exercise machine, comprising:

a frame;

a desk connected to the frame of the exercise machine, the desk including a first control module on a first side of the desk where the first control module is in communication with an exercise mechanism of the exercise machine; and a second control module located on the exercise machine off of the first side of the desk, wherein the second control module is disabled when the first control module is displayed to a user operating the exercise mechanism.

4. An exercise machine, comprising:

a frame;

a desk connected to the frame of the exercise machine, the desk including a first control module on a first side of the desk where the first control module is in communication with an exercise mechanism of the exercise machine;

a second control module located on the exercise machine off of the first side of the desk; and a memory storage medium comprising programmed instructions that, when executed, cause a processor to disable the second control module.

5. The exercise machine of claim 4, wherein the second control module is located in a hand hold of the exercise machine.

6. An exercise machine, comprising:

a frame;

a desk pivotally connected to the frame of the exercise machine, the desk including a first control module on a first side of the desk where the first control module is in communication with an exercise mechanism of the exercise machine when the desk is rotated about a pivot in a first position, the desk further including a back side shaped to support an object while the exercise mechanism is operating and when the desk is rotated about the pivot in a second position; and a second control module located on the exercise machine off of the first side of the desk, wherein the second control module is disabled when the first control module is displayed to a user operating the exercise mechanism.

7. An exercise machine, comprising:

a frame;

a desk pivotally connected to the frame of the exercise machine, the desk including a first control module on a first side of the desk where the first control module is in communication with an exercise mechanism of the exercise machine when the desk is rotated about a pivot in a first position, the desk further including a back side shaped to support an object while the exercise mechanism is operating and when the desk is rotated about the pivot in a second position; and a second control module located elsewhere on the exercise machine and including at least one control that is redundant to a control of the first control module, wherein the first control module is visible to a user operating the exercise mechanism when the desk is in the first position, and wherein the first control module is concealed from the user when the desk is rotated into the second position.

8. The exercise machine of claim 7, further comprising a memory storage medium comprising programmed instructions that, when executed, cause a processor to disable the second control module.

9. The exercise machine of claim 7, wherein the second control module is located on the back side of the desk and is visible to the user operating the exercise mechanism when the desk is rotated into the second position.

10. The exercise machine of claim 7, wherein the second control module is concealed from the user when the first control module is displayed to the user operating the exercise mechanism.

11. The exercise machine of claim 7, wherein an expanded level of control is accessible to the user operating the exercise mechanism when the desk is in the first position and a reduced level of control is accessible to the user when the desk is in the second position.

* * * * *